United States Patent [19]

Hough et al.

[11] 3,958,354

[45] May 25, 1976

[54] PROMOTIONAL TOKEN FOR A PULL TAB RING OPENER

[76] Inventors: Robert J. Hough, 437 Breezewood Drive, Ballwin, Mo. 63011; Ray Ponder, 2519 Sweetwater Trail, Maitland, Fla. 32751

[22] Filed: Jan. 9, 1973

[21] Appl. No.: 322,162

[52] U.S. Cl. ..... 40/307

[51] Int. Cl.[2] ..... G09F 3/00

[58] Field of Search ..... 40/2, 306, 307, 10; 220/54

[56] References Cited

UNITED STATES PATENTS

| | | | |
|---|---|---|---|
| 788,448 | 4/1905 | Wolfermann | 40/2 A |
| 2,522,398 | 9/1950 | Petersen | 40/307 |
| 2,880,533 | 4/1959 | Troendly | 40/10 R |
| 2,934,843 | 5/1960 | Henchert | 40/307 |
| 3,216,136 | 11/1965 | Lang | 40/10 R |
| 3,335,509 | 8/1967 | Braxton | 40/10 R |
| 3,712,503 | 1/1973 | Zundel | 220/54 |
| 3,822,496 | 7/1974 | Minder | 40/307 |

*Primary Examiner*—Louis G. Mancene
*Assistant Examiner*—Wenceslao J. Contreras

[57] ABSTRACT

A promotional token adapted for attachment to the pull tab ring opener of an easy-open container, characterized in that the token, which is preferably formed of a synthetic plastic material, includes a mounting portion adapted for insertion in the finger opening of the ring, and connecting means for removably fastening said token mounting portion in said ring opening. The connecting means may comprise a plurality of resilient lug means circumferentially spaced about the periphery of the mounting portion of the token, a continuous groove contained in the outer peripheral wall surface of the mounting portion, or lateral wing portions that extend outwardly from the mounting portion across the adjacent portions of the ring opener.

15 Claims, 9 Drawing Figures

Fig. 1
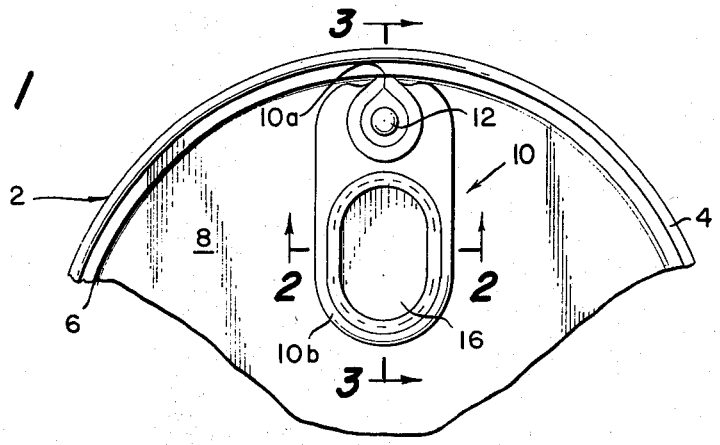
Fig. 2
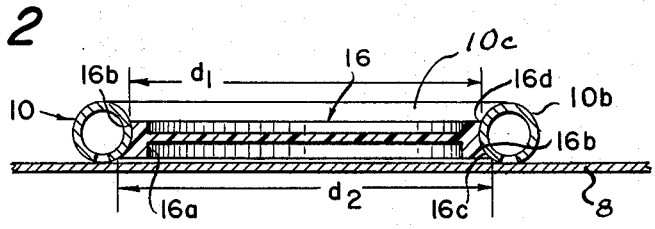
Fig. 3
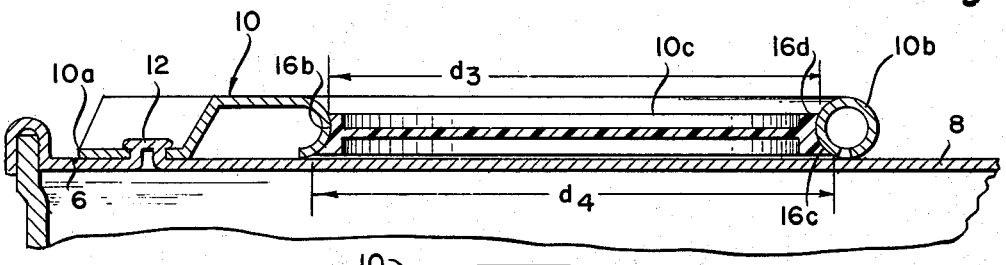
Fig. 4
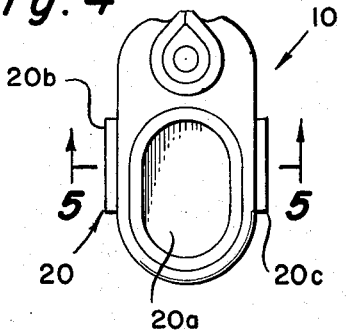
Fig. 8
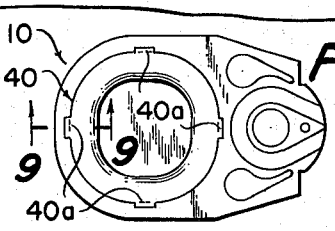
Fig. 6
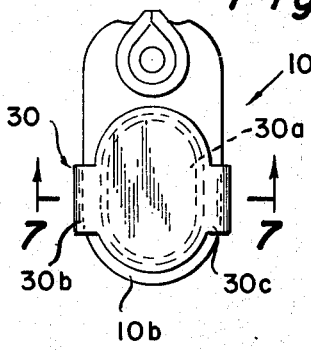
Fig. 9
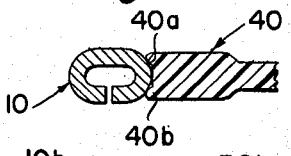
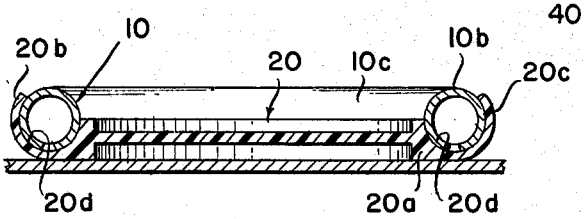
Fig. 5
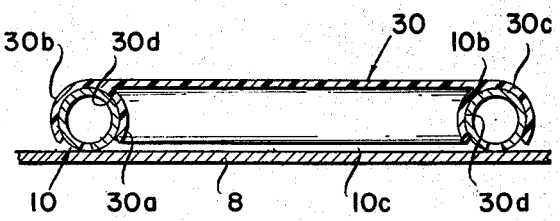
Fig. 7

PROMOTIONAL TOKEN FOR A PULL TAB RING OPENER

It is well known in the patented prior art—as evidenced, for example, by the patent to Henchert, U.S. Pat. No. 2,934,843; Brodie, U.S. Pat. No. 2,335,636; Sullivan, U.S. Pat. No. 2,186,940 and Guenard, U.S. Pat. No. 1,856,550—to provide containers with removable promotional tokens, "proof of purchase" buttons or the like. It is also known to mount advertising tags and indicia in the pouring handle rings of bottles and the like, as indicated, for example, by the patents to Strumor, U.S. Pat. No. 2,951,619 and Daly et al, U.S. Pat. No. 1,970,798.

In the container art, easy-open containers have become popular wherein a detachable full end panel is removed from the metal end closure member of a container by means of a pull tab ring opener that is connected with the removable panel by rivet means or the like, which opener is pivoted upwardly about the pivot axis defined by the rivet to cause the nose portion of the tab to initiate rupture of the scoreline that defines the removable panel, whereupon by applying a pulling force on the pull tab ring opener, the end panel is torn from the metal end.

The primary object of the present invention is to provide a promotional token that is specifically adapted for mounting in the finger opening of the pull tab ring opener of an easy open container. In accordance with an important feature of the invention, the promotional token includes a mounting portion having in cross-section an outer peripheral configuration that corresponds with that of the inner periphery of the finger opening, and connecting means operable when the token mounting portion is arranged in the finger opening for connecting the token member with the ring opener.

In accordance with a more specific object of the invention, the aforementioned means for connecting the token member with the ring opener comprises at least one resilient portion integral with and adjacent the outer periphery of the token mounting portion. In one preferred embodiment, the connecting means comprises a plurality of lug means arranged in circumferentially spaced relation about the periphery of the mounting portion. In another embodiment, the connecting means comprises a continuous groove contained in the outer peripheral wall portion of the mounting portion for receiving the inner peripheral edge portion of the ring. In a further embodiment, the connecting means comprises lateral wing portions that extend from the mounting portion outwardly beyond the ring, said wing portions containing grooves for receiving in locking engagement the adjacent portions of the ring.

Other objects and advantages of the invention will become apparent from a study of the following specification when viewed in the light of the accompanying drawing, in which:

FIG. 1 is a detailed plan view of an easy-open container and pull tab assembly provided with one embodiment of the promotional token of the present invention;

FIGS. 2 and 3 are sectional views taken along lines 2—2 and 3—3 of FIG. 1, respectively;

FIG. 4 is a plan view of an alternative embodiment of the invention;

FIG. 5 is a sectional view taken along line 5—5 of FIG. 4;

FIG. 6 is a plan view of another embodiment of the invention;

FIG. 7 is a sectional view taken along line 7—7 of FIG. 6;

FIG. 8 is a plan view of an pull tab to which is connected the preferred embodiment of the promotional token of the present invention; and FIG. 9 is a sectional view taken along line 9—9 of FIG. 8.

Referring first more particularly to FIGS. 1–3, the easy-open container 2 is provided with a customary metal end closure member 4 containing a scoreline 6 that defines a removable end panel 8. In order to remove this end panel, the container end is provided with a conventional pull tab ring opener 10 that is connected with the removable panel by rivet 12. The pull tab ring opener includes a nose portion **10*a* the extremity of which is arranged directly above the scoreline 6, and a ring portion 10*b* that contains a finger opening 10*c***.

In accordance with the present invention, there is connected with the pull tab ring opener 10 a planar promotional token 16 having a mounting portion **16*a* that has a configuration that corresponds with that of, and which is mounted within, the finger opening 10*c* of the pull tab ring opener. In order to mount the token within the opening, the peripheral side wall of the mounting body portion of the token is provided with a groove 16*b* that receives the corresponding inner peripheral edge of the ring portion 10*b*** of the pull tab opener.

According to an important feature of the invention, locking means are provided for preventing premature removal of the promotional token from the pull tab ring opener prior to opening of the container. In the embodiment of FIGS. 1–3, the outermost dimensions ($d_2$, $d_4$) of the lower peripheral flange portion **16*c* defined by the groove 16*b* are greater than the corresponding dimensions ($d_1$, $d_3$) of the upper peripheral flange portion 16*d*, whereby the lower flange portion defines locking means that extend partially beneath the pull tab opener between the opener and the removable end panel 8**.

In operation, to open the container of FIGS. 1–3, the finger portion **10*b* of pull tab ring opener 10 is elevated to effect pivotal movement of the opener in the vertical plane about rivet 12, whereupon the nose portion 10*a* of the tab opening is pivoted downwardly to shear the scoreline 6, thereby initiating removal of the end panel 8. If desired at this time, the promotional token 10 may be removed by displacing it downwardly relative to the ring portion 10*b***, whereupon the user's finger is then inserted within the ring opening during the removal of the remaining portion of the end panel. On the other hand, in certain instances, the promotional token may be left in place to afford a flat tab surface that can be gripped between the user's fingers during removal of the remaining portion of end panel (as might be desired, for example, by a female user having relatively long fingernails). Following complete removal of the end panel, the promotional token is then displaced downwardly relative to the pull tab ring portion to effect removal of the token.

Referring now to the alternative embodiment of FIGS. 4 and 5, the promotional token 20 includes a pair of laterally extending wing portions **20*b*, 20*c* that extend from the mounting portion 20***a* under the ring portion 10*b* of the pull tab opener to lock the token against removal from the container until the tab is pivoted upwardly in the container opening direction. Each wing portion contains an upwardly facing groove 20*d* that receives the corresponding lower surface of the ring portion 10*b*, thereby positively connecting the token with the tab opener.

In the modification of FIGS. 6 and 7, the token 30 has a pair of laterally extending wing portions 30*b*, 30*c* that extend from the mounting portion 30*a* above the corresponding parts of the ring portion 10*b*, said wing portions containing downwardly facing grooves 30*d* that receive the corresponding parts of the ring portion. In this embodiment, the token is not locked against removal when the tab opener is in its original horizontal inoperative position.

Referring now to the preferred embodiment of FIGS. 8 and 9, the token 40 includes a body portion having an outer peripheral configuration that corresponds generally with the inner periphery of the tab finger opening, said token being provided with circumferentially spaced lug means each of which comprises a pair of axially spaced outwardly extending lugs for receiving therebetween the inner peripheral edge portion of the ring opening, as shown in FIG. 9. Preferably the token is formed of a resilient synthetic plastic material, the resiliency of the lug means permitting ready connection and disconnection of the token relative to the ring.

It is apparent that the promotional token can contain advertising indicia, promotional material, such as pictures of athletes, proof-of-purchase indicia or the like.

While in accordance with the Patent Statutes the preferred form and embodiments have been described, it will be apparent that various modifications may be made in the disclosed promotional device without deviating from the inventive concept set forth herein.

What is claimed is:

1. A promotional container assembly, comprising, in combination:

a. an easy-open container having at one end a metal closure member containing a removable end panel portion;

b. means including a pull tab ring opener for removing said end panel portion; and c. a promotional token member including 1. a mounting portion having, in plan view, an outer peripheral configuration that corresponds with the inner peripheral configuration of the opening contained in the finger ring portion of the pull tab opener; and 2. means operable when said mounting portion is contained within said ring opening for connecting said token member with said ring opening.

2. A promotional token as defined in claim 1, wherein said connecting means comprises a plurality of locking lug means arranged in peripherally spaced relation about said token mounting portion.

3. A promotional token as defined in claim 2, wherein each of said locking lug means comprises a pair of axially spaced resilient locking lugs for receiving therebetween the adjacent inner peripheral edge portion of said ring opener.

4. A promotional token as defined in claim 1, wherein said connecting means comprises a locking recess contained in the outer peripheral wall surface of said mounting portion for receiving a corresponding inner peripheral edge portion of said ring opener.

5. A promotional token as defined in claim 4, wherein said locking recess comprises a continuous peripheral groove for receiving the inner peripheral edge portion of said ring opener.

6. A promotional token as defined in claim 5, wherein said body portion includes adjacent said groove a peripheral flange portion that is adapted to extend at least partially in the space between said ring opener and the container end wall associated therewith, thereby to prevent unauthorized removal of said token member from said ring opener.

7. A promotional token as defined in claim 1, wherein said connecting means comprises a pair of resilient wing portions that extend laterally from opposite sides of said mounting portion, each of said wing portions having a length greater that the corresponding cross sectional dimension of said ring portion, each of said wing portions containing a groove for receiving in locking engagement the adjacent portion of said ring opener.

8. A promotional token as defined in claim 7, wherein each of said portions is adapted to extend between the ring opener and the end wall of the container associated therewith.

9. A promotional token as defined in claim 7, wherein each of said wing portions is adapted to extend on the opposite side of said ring opener from the container end wall.

10. A display plate detachable to the opener of a pre-scored container top, said opener comprising a flat lever member permanently affixed to the pre-scored area of the container top and normally lying contiguous to the container top, and including; a planar member with a top display face and with a bottom face engageable upon said flat lever member, and an anchor depending from the bottom face of the planar member and having means disengageable with the lever member, whereby said display plate is detachably applicable to the container top with its display face exposed upwardly.

11. The detachable display plate for a container top with an opener as set forth in claim 10, wherein the lever member of the opener comprises a ring-shaped pull, and wherein the anchor depending from the bottom face of the planar member is divergent with respect to the inner periphery of the ring-shaped pull and forceably disengageable therewith.

12. The detachable display plate for a container top with an opener as set forth in claim 10, wherein the lever member of the opener comprises a ring-shaped pull, and wherein the anchor depending from the bottom face of the planar member is externally notched and forceably disengageable with the inner periphery of the ring-shaped pull.

13. The detachable display plate for a container top with an opener as set forth in claim 10, wherein the display plate coextensively overlies the lever member of the opener.

14. The detachable display plate for a container top with an opener as set forth in claim 10, wherein the display plate extends laterally from the lever member.

15. The detachable display plate for a container top with an opener as set forth in claim 10, wherein the display plate extends laterally from the lever member of the opener and substantially coextensively overlies the top of the container.

* * * * *

UNITED STATES PATENT AND TRADEMARK OFFICE

CERTIFICATE OF CORRECTION

PATENT NO. : 3,958,354

DATED : May 25, 1976

INVENTOR(S) : Robert J. Hough et al.

It is certified that error appears in the above-identified patent and that said Letters Patent are hereby corrected as shown below:

In the Heading, please add:

-- Assignee: Boise Cascade Corporation --

Signed and Sealed this

Fourteenth Day of December 1976

[SEAL]

*Attest:*

RUTH C. MASON
*Attesting Officer*

C. MARSHALL DANN
*Commissioner of Patents and Trademarks*